US011959728B2

(12) United States Patent
Lupo et al.

(10) Patent No.: US 11,959,728 B2
(45) Date of Patent: Apr. 16, 2024

(54) MISSILE GUIDANCE SYSTEM

(71) Applicant: Applied Research Associates, Inc., Albuquerque, NM (US)

(72) Inventors: Jasper C. Lupo, Albuquerque, NM (US); Joseph N. Paranto, Albuquerque, NM (US)

(73) Assignee: Applied Research Associates, Inc., Albuquerque, NM (US)

( * ) Notice: Subject to any disclaimer, the term of this patent is extended or adjusted under 35 U.S.C. 154(b) by 190 days.

(21) Appl. No.: 16/924,517

(22) Filed: Jul. 9, 2020

(65) Prior Publication Data

US 2021/0010783 A1 Jan. 14, 2021

Related U.S. Application Data

(60) Provisional application No. 62/872,529, filed on Jul. 10, 2019.

(51) Int. Cl.
*F41G 7/22* (2006.01)

(52) U.S. Cl.
CPC ..... *F41G 7/2253* (2013.01); *F41G 7/2206* (2013.01); *F41G 7/2293* (2013.01)

(58) Field of Classification Search
CPC ..... F41G 7/22–28; G02B 13/14; H04N 5/33
See application file for complete search history.

(56) References Cited

U.S. PATENT DOCUMENTS 2,823,612 A * 2/1958 Cox ..... F42B 10/46 359/736
2,963,973 A * 12/1960 Estey ..... F41G 7/2213 244/3.16
2,972,743 A * 2/1961 Svensson ..... H01Q 15/0013 250/353
3,000,307 A * 9/1961 Trotter, Jr. ..... F41G 7/2293 244/3.22
3,680,130 A * 7/1972 Jones, Jr. ..... H01Q 1/281 343/873
4,282,527 A * 8/1981 Winderman ..... G02B 17/0605 343/781 CA
4,309,946 A * 1/1982 Block ..... G01S 17/36 102/213
5,182,564 A * 1/1993 Burkett ..... F41G 7/2246 342/53
5,214,438 A * 5/1993 Brusgard ..... F41G 7/2246 343/781 CA
5,298,909 A * 3/1994 Peters ..... H01Q 21/28 342/53
5,307,077 A * 4/1994 Branigan ..... G01S 13/66 343/781 CA (Continued)

FOREIGN PATENT DOCUMENTS

EP 0628781 A1 * 12/1994

*Primary Examiner* — Matthew M Barker
(74) *Attorney, Agent, or Firm* — Erise IP, P.A.

(57) ABSTRACT

A hypersonic self-guided missile system is described. Particularly, embodiments describe missiles whose trajectories are controlled by an on-board control unit that decrease the effect of damaging heat to sensitive internal components by employing one or more annular windows, internal mirrors, lenses, and/or cameras. Embodiments may have an internal camera oriented substantially toward or away from the nose of the missile.

15 Claims, 7 Drawing Sheets

(56) References Cited

U.S. PATENT DOCUMENTS 5,327,149 A * 7/1994 Kuffer ..... H01Q 21/28 343/781 CA
5,372,333 A * 12/1994 Uwira ..... B64G 1/58 102/293
6,445,351 B1 * 9/2002 Baker ..... H01Q 19/193 343/781 CA
6,606,066 B1 * 8/2003 Fawcett ..... G01J 5/0808 343/781 CA
6,924,772 B2 * 8/2005 Kiernan, Jr. ..... F41G 7/2246 343/781 CA
7,183,966 B1 * 2/2007 Schramek ..... H01Q 21/28 342/27
7,804,053 B2 * 9/2010 Baker ..... F41G 7/224 250/203.1
8,274,027 B2 * 9/2012 Andressen ..... G02B 17/0896 250/203.1
8,575,527 B2 * 11/2013 Fry ..... F41G 7/2293 342/52
8,581,161 B2 * 11/2013 Taylor ..... G02B 27/141 342/52
8,921,748 B2 * 12/2014 Patel ..... G01S 3/781 244/3.13
9,618,756 B2 * 4/2017 Taylor ..... G02B 5/0825
9,696,117 B2 * 7/2017 Miller ..... F41G 7/2253
11,300,384 B2 * 4/2022 Davenel ..... G01S 7/4816
2006/0208193 A1 * 9/2006 Bodkin ..... G01J 5/06 250/353
2010/0127113 A1 * 5/2010 Taylor ..... F41G 7/2253 244/3.16
2012/0292431 A1 * 11/2012 Patel ..... G01S 3/781 250/226
2015/0253117 A1 * 9/2015 Naka ..... F42B 30/006 244/119

* cited by examiner

MISSILE GUIDANCE SYSTEM

RELATED APPLICATIONS

This application claims the benefit of U.S. Provisional Application No. 62/872,529, filed Jul. 10, 2019, and entitled "SYSTEM FOR IMPLEMENTING SEEKER IN A MISSILE," which is herein incorporated by reference in its entirety.

BACKGROUND

1. Field

Embodiments of the invention are broadly directed to self-guided missiles that autonomously adjust their trajectory towards a target in-flight. More specifically, embodiments of the invention are directed towards the guidance of a high-velocity missile towards its target through the implementation of a system that allows sensitive components, such as a camera and control unit, far from the very hot leading nose of the high-velocity missile.

2. Related Art

Accurately guiding a missile to its target is a difficult task, especially for a hypersonic missile that may be travelling at up to Mach 6. Such hypersonic missiles generate large temperature and pressure issues to be overcome and require very fast calculation of course corrections. Specifically, at such speeds difficulties may arise from factors such as (a) a lag in communication time between a missile and a remote guidance control system, (b) the computation time required to make adjustments to the flight path of a missile in response to commands from a remote guidance control system, and (c) variables that arise for particular instances of a missile's use (such as weather or environmental conditions and/or a target's speed and/or mobility). Accurately guiding a high-velocity missile to its target is of critical importance based upon the danger and damage to the environment, infrastructure, and/or nearby individuals that may result from improper guidance.

Conventionally, a high-velocity missile has been remotely command-guided to its target. Often, limitations with accuracy, precision, and/or dependability of tracking the speed, location, and distance to target of such a swift object may cause a missile to undesirably lose velocity, reducing its efficacy. Particularly, if the missile being guided is of a kinetic-kill type, a minimum amount of diversion from a ballistic path is preferred for conserving kinetic energy into the target, making an early and accurate flight path determination even more desirable. Furthermore, any potential loss of communication between the missile and remote guidance control system may be disastrous.

A preferable method is therefore to have the high-velocity missile track its own flight path, making real-time course corrections as necessary. Such a method may be performed through the implementation of autonomous adjustment of the missile's trajectory using an on-board seeking system ("seeker"). A seeker may non-exclusively comprise a sensor (for example, an infrared camera) as the primary input capturing light through a circular window, allowing the missile's computer to navigate towards a target by adjusting the flightpath to keep said target in the camera's field of view.

Such typical configurations of missiles making use of a seeker have provided a seeker and its components positioned near the front of the nose cone of a missile in order for the seeker to directly view the target. Unfortunately, the nose cone of missiles, particularly those traveling at hypersonic speeds, become extremely hot due to friction with surrounding atmosphere, potentially leading to damage to target-seeking components with disastrous consequences. In some cases, the tip of the nose cone of a hypersonic missile reaches temperatures as high as 1600° F. to 2000° F. during flight. Consequently, typical hypersonic missiles have been unable to fully utilize the superior guidance provided by autonomous seeking, requiring inferior remote control methods to be used. Therefore, what is needed is a new configuration of components within a missile to maximize navigation control while minimizing undesirable heat exposure to internal components, including camera and computer elements.

SUMMARY

Embodiments of the invention address this need by providing one or more annular windows in a missile, with one or more internal lenses, mirrors, and/or baffles to increase the distance between the hot nose of the missile and heat-sensitive components critical to the missile's guidance, such as a computer processor, graphics card, and/or one or more cameras. Embodiments of the invention may orient its camera substantially toward or away from the nose of the missile. Embodiments may include one or more secondary cameras for robustness and/or imaging incoming light in another waveband.

In a first embodiment, a missile system comprises a body having a nose cone tapering to a tip and at least one annular window. The one or more annular windows permit the passage of light from the direction of tip (the direction of flight of the missile). One or more internal mirrors redirects the incoming light to a camera, such as an infrared camera oriented away from the missile tip (that is, opposite the direction of flight of the missile), that generates still and/or moving images. Based at least in part on the images, a control unit comprising a processor adjusts the trajectory of the missile during flight. The camera may be placed within the missile at a location intended to increase its displacement from the very hot missile tip. Similarly, in embodiments, the processor may be placed within the missile at a location intended to increase its displacement from the very hot missile tip.

In a second embodiment, a missile system comprises a body having a nose cone tapering to a tip and at least one annular window. The annular window permits the passage of light from the direction of tip (the direction of flight of the missile). A first internal mirror directs incoming light into a second internal mirror, which redirects the light into a camera that generates one or more images. Based at least in part on the image(s), a control unit comprising a processor adjusts the trajectory of the missile during flight. The processor may be placed within the missile at a location intended to increase its displacement from the very hot missile tip. The camera may be oriented substantially away from the missile tip.

In a third embodiment, a self-guided missile system comprises a body tapering to a tip including at least one annular window formed in a portion of the perimeter of the body, that may be less than the entire perimeter of the body. An internal mirror is positioned to direct light from the annular window into a camera that generates images used to adjust the trajectory of the system during flight by a control unit. A beam splitter may split the incoming light to be directed into one or more additional cameras, which may operate on the same or different wavebands as the first camera. The additional camera(s) may provide alternative or failsafe trajectory adjustment and/or may be operable to produce video images to be transmitted to a remote location.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 3A:
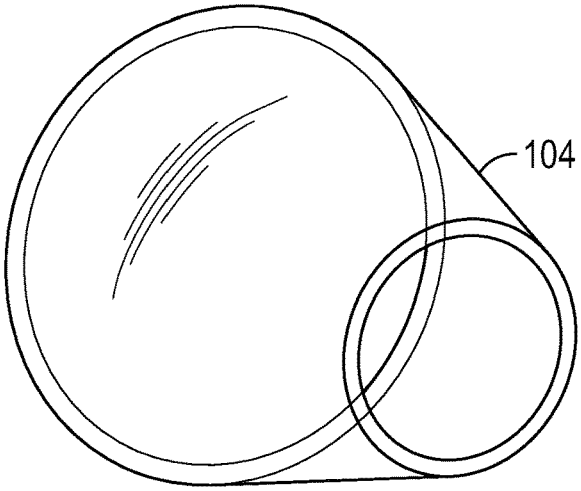
Figure 3B:
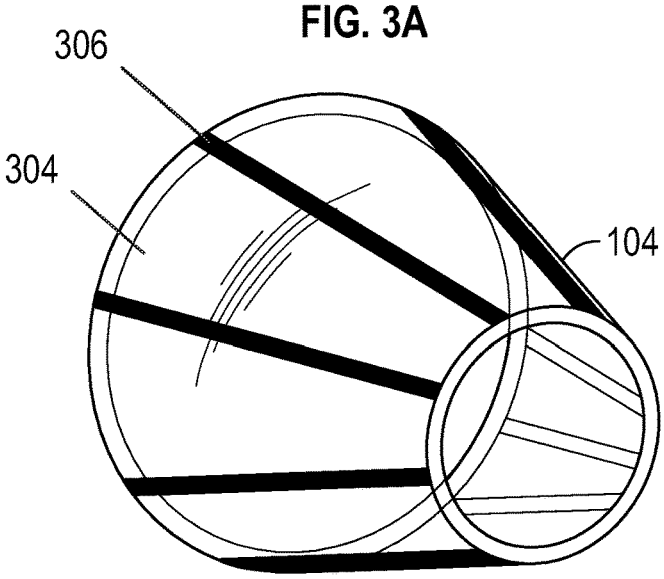
Figure 3C:
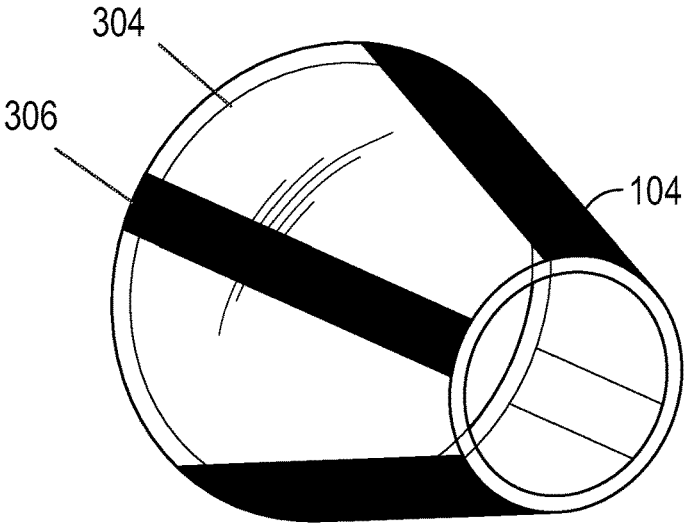
Figure 4:
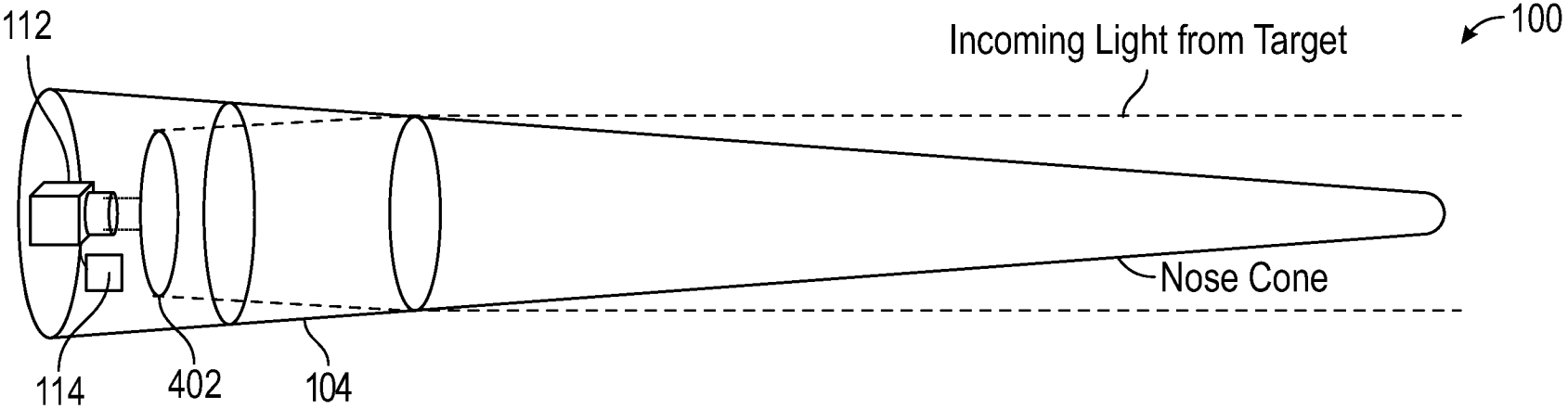
Figure 5:
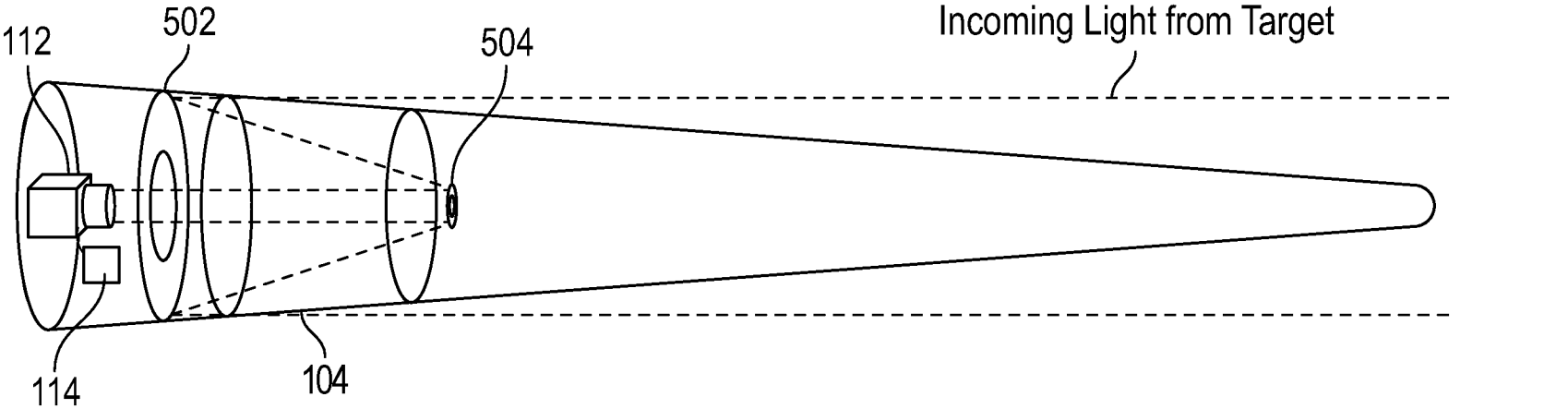
Figure 6:
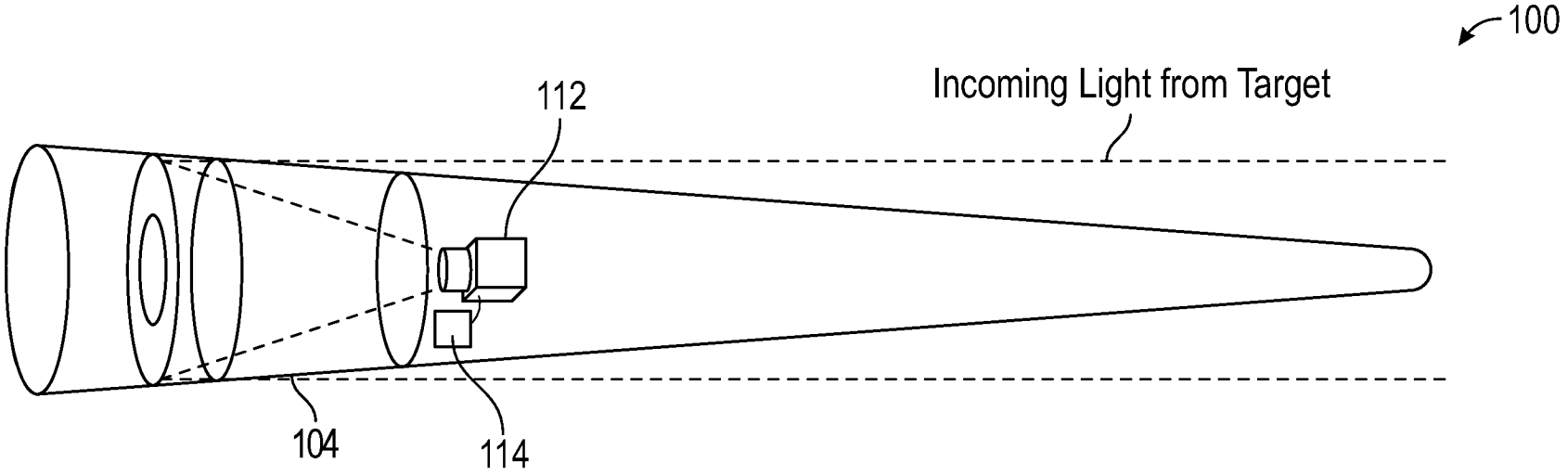
Figure 7:
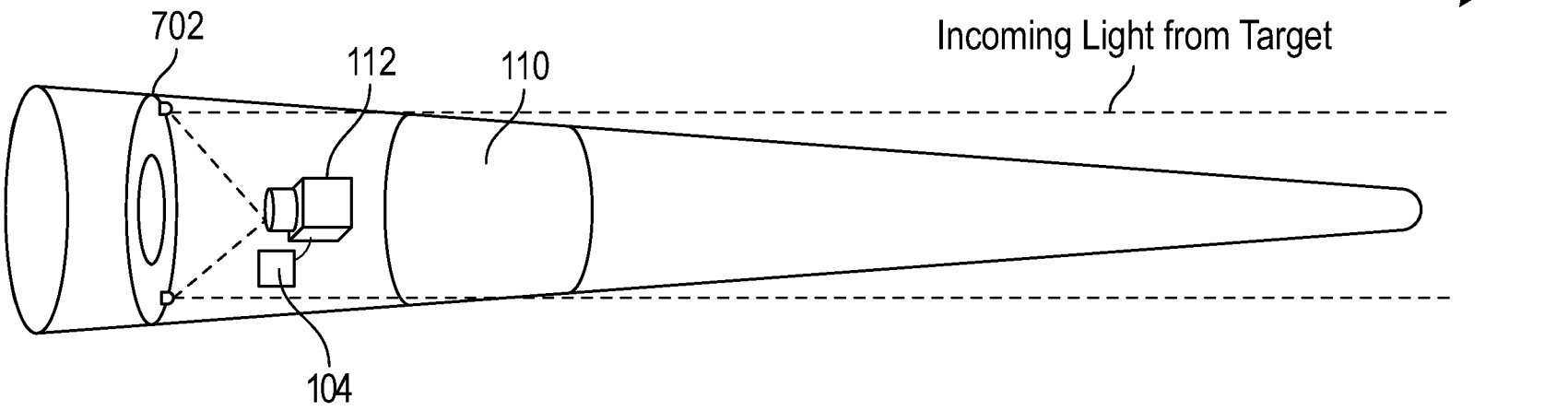
Figure 8A:
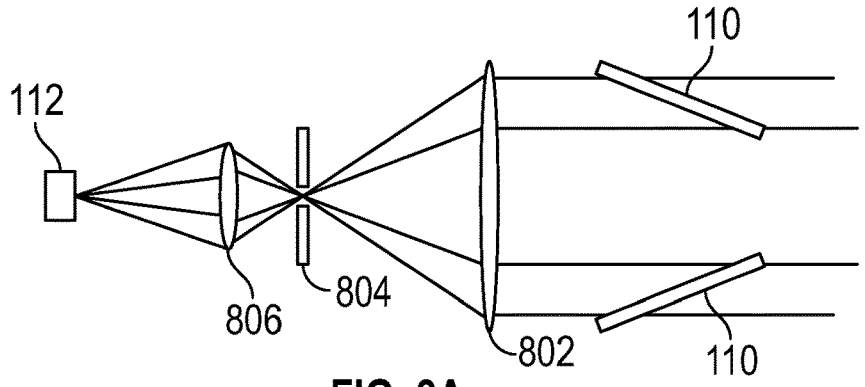
Figure 8B:
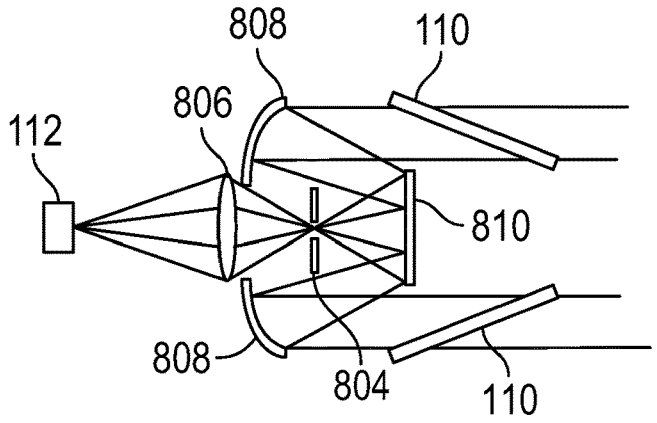
Figure 8C:
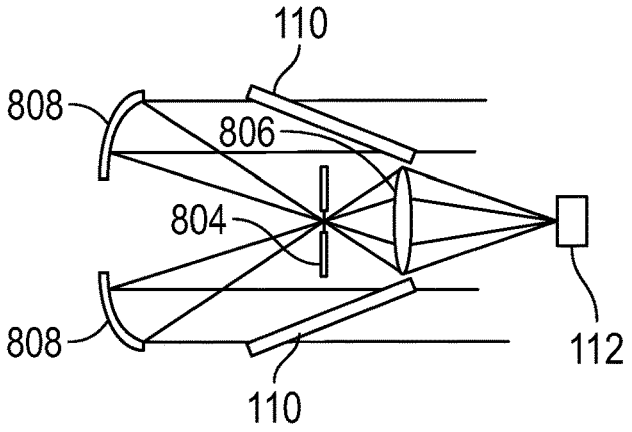
Figure 9A:
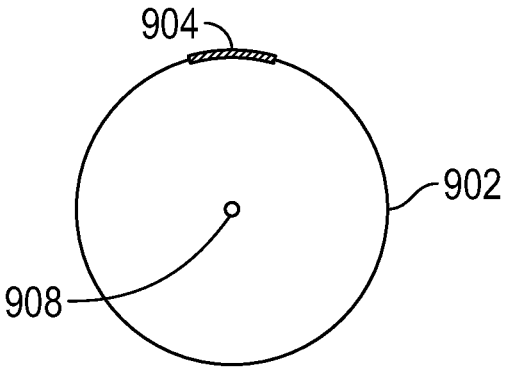
Figure 9B:
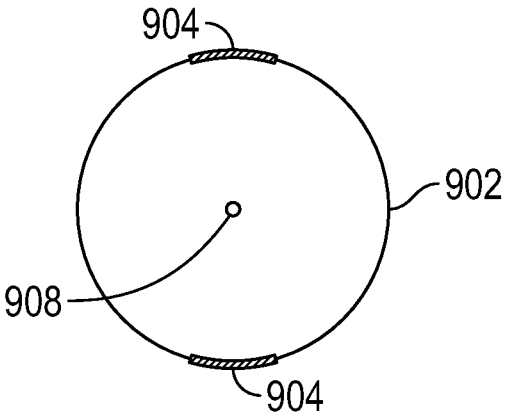
Figure 9C:
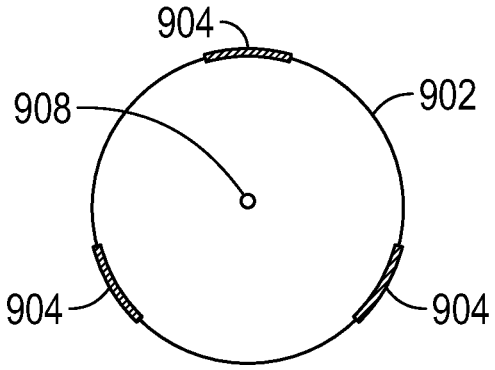

FIGS. 3A-C depict an annular window disposed in a nose cone of a self-guided missile;

FIG. 4 depicts a first embodiment of a self-guided missile;

FIG. 5 depicts a second embodiment of a self-guided missile;

FIG. 6 depicts a third embodiment of a self-guided missile;

FIG. 7 depicts a fourth embodiment of a self-guided missile;

FIGS. 8A-8C depict configurations of windows, lenses, mirrors, and cameras in embodiments; and FIGS. 9A-9C depict cross-sections of various embodiments of the invention.

The drawing figures do not limit the invention to the specific embodiments disclosed and described herein. The drawings are not necessarily to scale, emphasis instead being placed upon clearly illustrating the principles of the invention.

DETAILED DESCRIPTION

Embodiments of the invention solve the above-mentioned problems by providing a system wherein a seeker is used for missile guidance, configured to provide the sensitive components critical for target seeking, such as a control unit and camera, far from the tip of the missile's nose cone, which is typically significantly hotter than the cone's base. Various embodiments may comprise a window or set of windows to allow light from the target to enter the missile nose cone, an optical subsystem comprising one or more mirrors and/or lenses, a sensor for viewing the light from the target captured by the windows, and a control unit for processing the viewed light into images used to adjust the trajectory of the missile towards a target or location.

Embodiments of the invention may implement a group of windows of varying number, and may additionally or alternatively implement a window with any feasible shape other than conical. The window or set of windows may be placed at a location back along the length of the nose cone, where it will experience a lower temperature than the tip and encounter less stress and pressure. Placing the window in such an area may also reduce the intensity and/or number of shock waves to the window. In some embodiments, the window or set of windows may be formed such that several structural elements disposed within the window may act as supporting struts. Struts may be formed of highly-insulating materials meant to protect internal components from heat while providing structural support. Embodiments may further provide phase change material (PCM) in the nose cone of the missile or elsewhere to absorb thermal energy, further protecting the sensitive components of the seeker.

The subject matter of embodiments of the invention is described in detail below to meet statutory requirements; however, the description itself is not intended to limit the scope of claims. Rather, the claimed subject matter might be embodied in other ways to include different elements, structures, steps, or combinations of steps similar to the ones described in this document, in conjunction with other present or future technologies. Minor variations from the description below are intended to be captured within the scope of the claimed invention. Terms should not be interpreted as implying any particular ordering of various steps described unless the order of individual steps is explicitly described.

The following detailed description of embodiments of the invention references the accompanying drawings that illustrate specific embodiments in which the invention can be practiced. The embodiments are intended to describe aspects of the invention in sufficient detail to enable those skilled in the art to practice the invention. Other embodiments can be utilized, and changes can be made without departing from the scope of the invention. The following detailed description is, therefore, not to be taken in a limiting sense. The scope of embodiments of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate reference to "one embodiment" "an embodiment", or "embodiments" in this description do not necessarily refer to the same embodiment and are also not mutually exclusive unless so stated and/or except as will be readily apparent to those skilled in the art from the description. For example, a feature, structure, or act described in one embodiment may also be included in other embodiments but is not necessarily included. Thus, the technology can include a variety of combinations and/or integrations of the embodiments described herein.

Operational Environment for Embodiments of the Invention

Figure 1:
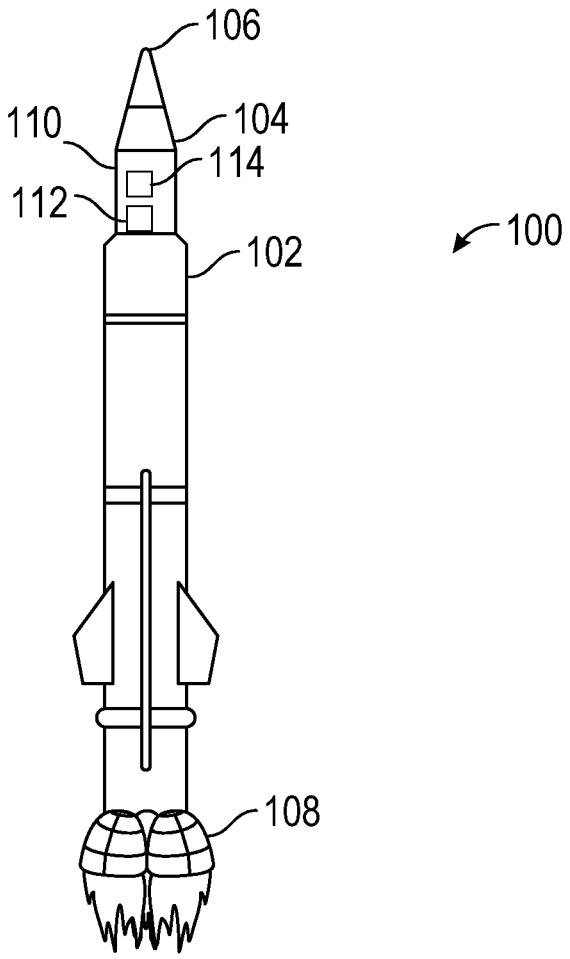
FIG. 1 depicts an overall illustration of an exemplary missile.

Turning first to FIG. 1, an exemplary missile system 100 is illustrated, including a body 102 having nose cone 104 tapering to a tip 106. In embodiments, body 102 may seamlessly taper to tip 106, with the boundary of nose cone 104 defined by internal components and/or walls. Missile system 100 includes thrusters 108 that are operable to drive the missile and/or adjust its trajectory. In embodiments the missile body is substantially cylindrical, having a circular or nearly circular cross-section as viewed from the tip. This is not intended as limiting. Any missile body that tapers to a leading tip is intended for inclusion in embodiments. An internal camera 112 is communicatively coupled to a control unit 114, which is operable to adjust the trajectory of the missile. As discussed below, the location of the camera 112 and control unit 114 is not limited to the locations shown in FIG. 1, but rather may be placed at a variety of locations within body 102 in particular embodiments.

FIG. 1 illustrates an annular window that may be formed in the body of the missile, and may particularly be located in the nose cone. Annular window 110 is illustrated as being semi-conical, wrapping around the entirety of the perimeter of missile body 102 and comprising the majority of the surface area of nose cone 104 (other than the leading tip 106), but this is not intended as limiting. As will be further discussed below, in embodiments annular window 110 may extend around only a portion of the perimeter of the missile, may be disposed in multiple locations about the perimeter of the missile, or may be significantly smaller than nose cone 104. In embodiments, annular window 110 may be thin, having a length that is three or more times its length.

The annular window allows light to be transmitted into the nose cone of the missile from the missile's target. This captured light may allow the camera 112 to maintain a view of a target once detected. In some embodiments of the invention, the window may be a single conical piece that encompasses the entire outer surface of the nose cone in the region of said nose cone that it occupies. In such an embodiment, the window provides the sensor with an annular view to use in detecting a target image. In embodiments, the one or more annular windows may be seamless, minimizing the deleterious effect of air turbulence, which is significant and destructive at such high speeds. In embodiments, the one or more annular windows may comprise at least one support strut or rod to provide strength to the window(s). In order to incorporate such struts, portions of the window may be machined out during fabrication of the missile. In various embodiments struts may be formed of highly-insulating materials meant to protect the seeker from heat while providing structural support. Embodiments may additionally or alternatively provide phase change material (PCM) within the nose cone of the missile or elsewhere in the missile body to absorb thermal energy, further protecting the sensitive components of the seeker. In various embodiments, the location of the window or set of windows will be positioned at least 10 centimeters away from the tip of the nose cone, exploiting a sharp decrease in the temperature of the nose cone to reduce unwanted heating of sensitive internal components. Placing the window at least 10 cm from the tip may also reduce the amount of shock wave variations experienced by the window.

The annular window(s) provided in embodiments are composed of a transmissive material to allow light from the missile's environment to pass. The window material may be selected to transmit over the same wavelength band that used by the camera, acting as a preliminary filter for the system. In one embodiment, the material will transmit specifically between 3 and 5 micrometers. Such an embodiment may make use of materials such as fluorides, sapphire, silicon, or ALON for the window. These embodiments are not intended as limiting. The annular window(s) may be formed of any desired appropriate material and may or may not be used as a preliminary filter to the camera.

Figure 2:
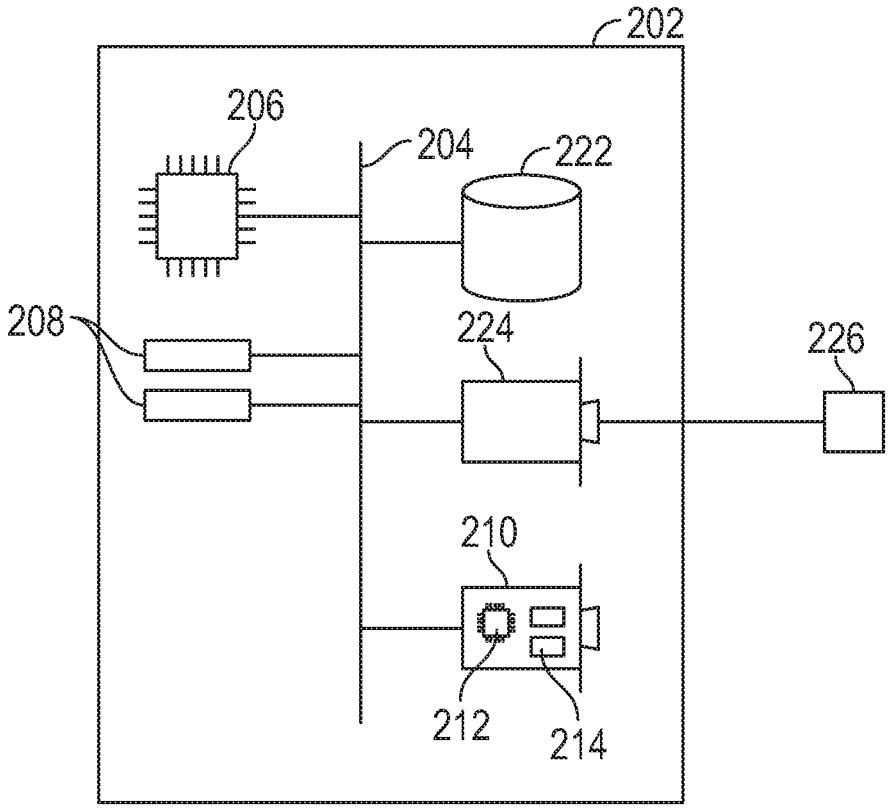
FIG. 2 depicts elements of internal hardware that may be present in embodiments.

Turning now to FIG. 2, an exemplary platform that may be utilized in certain embodiments of the system is depicted. In some embodiments, certain components may be arranged differently or absent. Additional components may also be present. Control unit 114 may comprise any or all of the elements illustrated in FIG. 2. Further, control unit 114 may comprise elements not illustrated in FIG. 2, such as a thruster control system or actuators. The control unit 114 in embodiments of the invention is operable to adjust the trajectory of the missile based on images generated by one or more cameras from light incident through one or more windows, received by one or more mirrors.

Computing module 202 may be any form factor of general- or special-purpose computing device. Depicted with computer 202 are several components, for illustrative purposes. In some embodiments, certain components may be arranged differently or absent. Additional components may also be present. Included in computing module 202 is system bus 204, whereby other components of computing module 202 can communicate with each other. In certain embodiments, there may be multiple busses or components may communicate with each other directly. Connected to system bus 204 is central processing unit (CPU or "processor") 206. Also attached to system bus 204 are one or more random-access memory (RAM) modules 208. Also attached to system bus 204 is graphics card 210. In some embodiments, graphics card 210 may not be a physically separate card, but rather may be integrated into the motherboard or the CPU 206.

In some embodiments, graphics card 210 has a separate graphics-processing unit (GPU) 212, which can be used for graphics processing or for general purpose computing (GPGPU). Also on graphics card 210 is GPU memory 214. Also connected to system bus 204 is local storage 222, which may be any form of computer-readable media, and may be internally installed in computing module 202 or removably attached.

Network interface card (NIC) 224 is also attached to system bus 204 and allows computing module 202 to communicate over a network such as network 226. NIC 224 can be any form of network interface known in the art, such as Ethernet, ATM, fiber, Bluetooth, or Wi-Fi (i.e., the IEEE 802.11 family of standards), radio, or satellite transmission. NIC 224 connects computing module 202 to local network 226, which may also include one or more other computers, data stores, and/or satellites. Generally, a data store may be any repository from which information can be stored and retrieved as needed. Examples of data stores include relational or object oriented databases, spreadsheets, file systems, flat files, directory services such as LDAP and Active Directory, or email storage systems. A data store may be accessible via a complex API (such as, for example, Structured Query Language), a simple API providing only read, write and seek operations, or any level of complexity in between. Some data stores may additionally provide management functions for data sets stored therein such as backup or versioning. Data stores can be local to a single compute or remotely accessible over a network such as local network 226. In some embodiments, steps of methods disclosed may be performed by a single processor 206, single computing module 202, single memory 208, and single data store, or may be performed by multiple processors, computers, memories, and data stores working in tandem.

An optical subsystem that may comprise one or more lenses, mirrors, and apertures, in embodiments, are positioned within the missile to direct and focus incoming light from one or more annular windows to one or more cameras. The optical subsystem may include baffles for minimizing interference from unwanted stray light. The camera then feeds the data it receives in the form of this incoming light to the processor 206, which determines the status of the missile relative to its target to make the necessary guidance corrections to reach said target. Specifically, the control unit 114 comprising elements of FIG. 2 is operable to adjust the trajectory and/or speed of the missile based on moving and/or still images produced by camera 112 from light received through one or more annular windows from the direction of travel of the missile (towards the tip).

In embodiments, camera 112 may be an infrared camera, a visible spectrum camera, or may operate on any other desired wavelength of light. Specifically, in embodiments, camera 112 may generate images from light having a wavelength in a range from three to five micrometers, commonly known as the mid-wave infrared (MWIR) band, which may be particularly advantageous when flying within earth's atmosphere. In other embodiments, the camera may operate at any range within the long-wave infrared band (LWIR, between 8 and 11 micrometers) or short-wave infrared band (SWIR, less than three micrometers). In some embodiments, multiple cameras may be employed for robustness and/or alternative options of target tracking. In some embodiments, the cameras may operate on the same wavelength range, providing a failsafe operation in case of fault in one camera. In other embodiments, the cameras may operate on different wavelength ranges, allowing for targeting within multiple wavebands, some of which may be more or less desirable in particular instances, environments, brightness levels, and/or weather conditions. In embodiments, an additional camera may be operable to produce video of the surrounding environment and/or target, which may be stored in memory and/or transmitted to a remote location. Specifically, in an embodiment, a first camera may be an infrared (IR) camera, while a second camera may be a visible light camera. In embodiments including multiple cameras, a beam splitter may be positioned to split the incoming light into two beams, one corresponding to each camera. This is not intended to be limiting. Embodiments may include any number of cameras, and may or may not use any number of beam splitters in order to direct light into each of the cameras. In embodiments, a plurality of annular windows is provided in the missile body, and light from each window is directed into respective ones of multiple cameras to produce images, which may then be used alone or in tandem to adjust the trajectory and/or speed of the missile. Some embodiments may include additional methods of target and/or location tracking.

Optical subsystems present in embodiments may be catadioptric (wherein refractive and reflective optical components are combined), and may include focal and/or afocal telescopes, providing an apparatus by which the light allowed in through the window can be guided to the camera in a way that allows the camera to detect the image of the missile's current target. Embodiments of the invention may include one or more limiting apertures in the optical subsystem to reduce thermal background and prevent stray light from reaching the imaging focal plane array (commonly "FPA") including the target. The optical subsystem's components may reflect and/or reimage the light transmitted through the window or set of windows to present the desired image to the focal point array. In various embodiments, portions of the optical subsystem may have a fixed position, while in others some or all of the devices may be mobile. For instance, mirrors and/or lenses within the system may be provided on actuators to adjust their position, thereby adjusting the focus of the imaged FPA. In embodiments, the optical subsystem may include one or more mirrors fiber optic cables having a variety of lengths, attenuations, chromatic dispersions, and/or any other properties of fiber optics. The mirrors and/or lenses of the optical subsystem may comprise a variety of sizes, shapes, and curvatures as required to form the optical subsystem to direct the captured light to the sensor. Mirrors and/or lenses may also vary in focal length, concavity, and any other known optical property that would allow the mirrors and/or lenses to achieve their purpose of directing, refocusing, and re-imaging the captured light to for the camera(s). In specific embodiments, the optical subsystem of a missile may comprise two mirrors and a lens assembly, wherein the lens is located between the second mirror and the camera.

Mirrors in embodiments of the invention may be formed as a flat, planar mirror, a parabolic mirror, a portion of a parabolic mirror, or any other appropriate desired shape. Mirrors may be concave or convex. For instance, a mirror may be generally of a parabolic shape but include one or more large voids (as compared to a complete parabolic mirror) to reduce the weight of the mirror. Specifically, the voids may be shaped such that only the portion of the mirror illuminated by light from one or more annular windows is present, removing the rest during fabrication of the missile to minimize weight. This is only one example of a way in which the size and shape of a mirror may correspond the size and shape of a window. Mirrors, in embodiments, may have a length (or any other dimension) that is equal to the corresponding dimension in a window. Alternatively, a mirror may have a shape that is precisely some multiple of the shape of a window, such as one third as large in each dimension or twice as large in each dimension. In embodiments, windows and corresponding mirrors may have the same, irregular shape. In a specific embodiment, a mirror has a length and a width corresponding to a length and a width of the annular window.

FIGS. 3A-3C illustrate an embodiment of nose cone 104 including an annular window 304. As illustrated in FIGS. 3B-3C, the window 304 is significantly shorter in its height than its width, making for a relatively long, thin window. In the case where the nose cone is a true cone, the annular window is formed as a section of a circular ring, with the top of the ring slanted toward the nose tip 108 and the bottom of the ring slanted away from the nose tip. In embodiments, the annular window may be an entire slanted circular ring, rather than only a portion, or may be several ring sections disposed about the circumference of the nose cone. A number of supporting members 306, such as struts or rods, are illustrated in FIGS. 3B-3C to provide structural integrity to the annular window, and may be present in any of the described embodiments of the invention. Camera(s) and image processing systems of embodiments may be configured to be tolerant of obstructions in the visual field of the windows. Support members 306 may be encased within the material of the annular windows, may be just inside or just outside the annular windows, or may extend completely through the width of the annular windows. Support members need not be vertically arranged, as illustrated, but alternatively may be horizontal, diagonal, and/or may form a web-like structure, in a regular or irregular pattern.

Each of FIGS. 4-7 illustrates internal orientations of windows, cameras, and mirrors in embodiments of the missile guidance system. These orientations are not intended as limiting, but rather as examples of conceptual arrangements of elements comprising the missile's optical subsystem that may be particularly advantageous for implementations. The arrangements illustrated in FIGS. 4-7 can be broadly separated into those with a substantially forward-facing camera (FIGS. 4 and 5) and those with a substantially rearward-facing camera (FIGS. 6 and 7). By "substantially forward," it is intended that the camera illustrated points more toward the tip of the missile than toward the rear (where thrusters are generally located). Similarly, by "substantially rearward," it is intended that the camera illustrated points more toward the rear of the missile than toward the tip. In other words, were the missile bisected by a line perpendicular to the height of the missile (and, generally, the direction of flight of the missile), a forward facing camera would have a ray extending outward from its lens pointing above this bisecting line, while a rearward facing camera would have a ray extending outward from its lens pointing below this bisecting line. This is only intended for discussion of the arrangements in embodiments. Embodiments may include a camera aligned with such a bisecting line, perpendicular to the height of the missile, pointed either towards its center or towards its exterior. Further, embodiments may include a plurality of cameras having any of these orientations, including each having a different orientation or each having the same orientation.

FIG. 4 illustrates an embodiment in which a camera 112 is oriented forward, receiving light directly from an annular window 110. In this embodiment, light from the windows is not reflected by any mirrors. Control unit 114 receives images produced by the camera 112 and adjusts the trajectory of the missile accordingly. Trajectory adjustments may include a change in speed, direction, and/or orientation of missile elements, such as wings or flaps. A telescopic lens assembly 402 is used to focus the light for imaging prior to capture by the camera 112. Such a lens assembly may be employed in any of the embodiments described. In some embodiments, a lens assembly may be employed to focus light to a desired optical magnification prior to capture by the camera. As illustrated in the embodiment of FIG. 4, the distance from each of the camera 112 and processor 114 to the tip of the missile is greater than the distance from the window 110 to the tip of the missile.

FIG. 5 illustrates an embodiment in which a camera 112 is oriented forward, receiving light from an annular window 110 via a pair of mirrors 502 and 504. Mirror 502 condenses then incoming beam of light to be directed into camera 112 via mirror 504, and as such mirror 502 is much larger than mirror 504. Though the window and mirrors are illustrated as encircling the entirety of a conical missile body, this is not intended as limiting. Any shape or arrangement of missile body and window is intended for inclusion in embodiments. As shown, mirror 502 is a parabolic mirror with a central void, though this is not intended as limiting. As further shown, the arrangement of FIG. 5 maximizes the distance between camera 112 and the hot tip of the missile. As in FIG. 4, the distance from each of the camera 112 and processor 114 to the tip of the missile is greater than the distance from the window 110 to the tip of the missile. Again, control unit 114 receives images produced by the camera 112 and adjusts the trajectory of the missile accordingly.

FIG. 6 illustrates an embodiment in which a camera 112 is rearward facing (that is, facing away from the tip of the missile). Such an arrangement may be used, for example, to make the best use of space within the missile, or centralize particular internal components of the missile, or to keep camera 112 further from thrusters 108 at the rear of the missile than in forward-facing camera embodiments. As seen in FIG. 6, light incoming from the direction of flight through annular window 110 is reflected by mirror 602 directly into camera 112. As shown, mirror 602 is a parabolic mirror with a central void, though this is not intended as limiting. Again, control unit 114 receives images produced by the camera 112 and adjusts the trajectory of the missile accordingly.

FIG. 7 illustrates an alternative embodiment in which a camera 112 is rearward facing. Again, light incoming from the direction of flight through annular window 110 is reflected by a mirror 702 directly into camera 112. However, in this arrangement, the camera 112 is located between the mirror 702 and window 110 (as opposed to the window 110 being located between the mirror 602 and the camera 112, as in FIG. 6), such that the camera 112 is farther from the tip of the missile than the window. As shown, mirror 702 is a parabolic mirror with a central void, though this is not intended as limiting. Again, control unit 114 receives images produced by the camera 112 and adjusts the trajectory of the missile accordingly. As in the previous embodiment described with respect to FIGS. 4 and 5, the distance from the processor 114 to the tip of the missile is also greater than the distance from the window 110 to the tip of the missile, now with a rearward-facing camera arrangement.

FIGS. 8A-8C illustrate embodiments of possible arrangements of mirrors, lenses, and apertures relative to a camera that may be present in embodiments. These arrangements are not to scale, and should not be construed as such. Arrangements may be modified, combined, or simplified in any appropriate manner and still fall within particular embodiments of the missile system.

FIG. 8A illustrates light entering the interior of a missile through windows 110. Windows 110 may be separate windows, or may be two portions of a single window illustrated in cross-section. A first lens 802 focuses the incoming light, after which it passes through an aperture 804, reducing incoming light from undesired sources, before being re-imaged by a second lens 806 prior to entering a forward-facing camera 112.

FIG. 8B illustrates light entering the interior of a missile through windows 110. Windows 110 may be separate windows, or may be two portions of a single window illustrated in cross-section. Incoming light is reflected by a first parabolic mirror 808 and a second planar mirror 810. Mirror 810 may be round, substantially rectangular, or any other appropriate shape. The reflected light then passes through an aperture 804 and a void in the first parabolic mirror 808 before being re-imaged by a lens 806 prior to entering a forward-facing camera 112.

FIG. 8C illustrates light entering the interior of a missile through windows 110. Windows 110 may be separate windows, or may be two portions of a single window illustrated in cross-section. Incoming light is reflected by a first parabolic mirror 808. The light then passes through an aperture 804 and is re-imaged by a lens 806 prior to entering a rearward-facing camera 112. The configuration of FIG. 8C provides a more compact optical subsystem that may be particularly advantageous in smaller missiles or in missiles having limited internal space, though the configuration of FIG. 8C locates the camera closer to the hot tip of the missile than either of FIG. 8A or 8B.

Illustrated in FIGS. 9A-9C are possible arrangements of annular windows about the perimeter of a cross-section of a missile. The illustrated arrangements are merely exemplary, and are not intended as limiting. The illustrated embodiments display a circular cross-section with one or more annular windows, but the conceptual arrangements of window(s) are equivalently applicable to other cross-sectional shapes. It should be understood that in all of the configurations shown in FIGS. 9A-9C the window shown in the illustration may comprise of a single conical window or a group of windows of varying number, and may additionally or alternatively comprise of a window with any feasible shape other than conical. Furthermore, while FIGS. 9A-9C show exemplary embodiments of the invention, embodiments are not limited to the configurations shown and may comprise further variations in the number, type, and position of optical components.

FIG. 9A illustrates an annular window 904 disposed in only a portion of missile body 902. In this embodiment, the tip of the nose cone 908 is shown at the center, with annular window 904 disposed in a portion of the perimeter of the missile body that is less than half of its total perimeter (circumference, in this case, because the cross-section is circular). In other embodiments, the annular window may be disposed in more than half of the perimeter or may encircle the entire perimeter of the missile body. The annular window (s), in embodiments, is/are disposed in nose cone 104 of FIG. 1.

As illustrated in FIG. 9B, a pair of annular windows are disposed in the missile body 902 opposite one another as seen from a cross-sectional view. In embodiments, these windows may be disposed at the same distance along the body from the tip of the missile 908 or may be at different positions along the length of the missile. As described above, an internal optical subsystem comprising one or more mirrors and/or lenses may direct the light from each of the windows into a single camera, or may utilize a beam splitter to direct the light into a plurality of cameras. In embodiments, the light from each window may have a 1-to-1 correspondence with a particular camera.

FIG. 9C illustrates an embodiment in which three windows 904 are evenly spaced about the perimeter of the missile body 902. In embodiments, may be any number of windows may be disposed about the circumference of the missile body, evenly spaced or unevenly spaced, as desired. In embodiments, a large number of very narrow windows may be disposed about the entire perimeter of the missile body, with an alternating pattern of annular windows and body material. In certain embodiments, windows may specifically be placed 180°, 120°, or 90° apart around the circumference of a substantially cylindrical missile body. Of course, these embodiments are not intended as limiting. A plurality of annular windows, in embodiments, may be unevenly disposed about the perimeter of the missile body, or disposed in any other desired arrangement. In an embodiment, a plurality of missiles may be disposed at the same location about the perimeter of the missile body, with different positions along the body of the missile (that is, each window is a different distance from the hot tip 106 of the nose cone).

Many different arrangements of the various components depicted, as well as components not shown, are possible without departing from the scope of the claims below. Embodiments of the invention have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims. Although the invention has been described with reference to the embodiments illustrated in the attached drawing figures, it is noted that equivalents may be employed, and substitutions made herein without departing from the scope of the invention as recited in the claims. For example, though embodiments of the system have been described with regards to a self-guided hypersonic missile, embodiments may be appropriately utilized in subsonic missiles, missiles that additionally include remote guidance, and/or flight systems including autonomous or semi-autonomous drones, space modules, and airplanes.

Having thus described various embodiments of the invention, what is claimed as new and desired to be protected by Letters Patent includes the following:

1. A hypersonic missile system comprising:
a missile body comprising a nose cone;
a set of thrusters configured to provide thrust to propel the hypersonic missile system to hypersonic speeds;
a plurality of windows formed in at least a portion of the nose cone, wherein the plurality of windows is configured to filter out unwanted wavelengths of light providing filtered light to an interior of the nose cone;
a plurality of cameras disposed in the nose cone and configured to receive the filtered light,
wherein each camera of the plurality of cameras is configured to detect a different wavelength of light;
an optical subsystem disposed within the nose cone, the optical subsystem comprising:
a plurality of mirrors configured to reflect the filtered light,
wherein a first mirror of the plurality of mirrors is configured to direct the filtered light onto a second mirror of the plurality of mirrors and the second mirror is configured to direct the filtered light into at least one camera of the plurality of cameras; and
a limiting aperture configured to filter thermal background radiation;
wherein the plurality of windows is disposed at least ten centimeters from a tip of the nose cone to reduce thermal effects and an amount and an intensity of a plurality of shock waves at the plurality of windows generated by the hypersonic speeds; and
a control unit operable to adjust a real-time trajectory of the hypersonic missile system based on at least one image formed by the plurality of cameras created from the filtered light from the plurality of windows
wherein each mirror of the plurality of mirrors has a one-to-one correspondence to each window of the plurality of windows.

2. The hypersonic missile system of claim 1,
wherein each mirror of the plurality of mirrors of the optical subsystem correspond to a window of the plurality of windows, and
wherein mirror shapes of each mirror correspond to window shapes of each corresponding window.

3. The hypersonic missile system of claim 1, wherein the filtered light includes only wavelengths between three and five micrometers.

4. The hypersonic missile system of claim 1, wherein the plurality of cameras comprises a first camera operating in short-wave infrared band, a second camera operating in a mid-range infrared band, and a third camera operating in a long-range infrared band.

5. The hypersonic missile system of claim 1, wherein the plurality of windows is closer to the tip of the nose cone than the control unit, the plurality of cameras, and the optical subsystem.

6. The hypersonic missile system of claim 1, wherein each window of the plurality of windows is configured to filter a wavelength of light corresponding to a camera of the plurality of cameras.

7. A hypersonic missile system comprising:
a missile body comprising a nose cone;
a set of thrusters configured to provide thrust to propel the hypersonic missile system to hypersonic speeds;
a plurality of windows formed in at least a portion of the nose cone,
wherein the plurality of windows is configured to filter wavelengths of light providing filtered light to an interior of the nose cone;
a plurality of cameras disposed in the nose cone and configured to receive the filtered light,
wherein each camera of the plurality of cameras is configured to detect a different wavelength of light;

an optical subsystem disposed within the nose cone, the optical subsystem comprising:

a plurality of mirrors configured to reflect the filtered light, wherein a first mirror of the plurality of mirrors is configured to direct the filtered light onto a second mirror of the plurality of mirrors and the second mirror is configured to direct the filtered light into at least one camera of the plurality of cameras; and a aperture configured to filter thermal background radiation;

wherein the plurality of windows is disposed at least ten centimeters from a tip of the nose cone to reduce thermal effects and a number and an intensity of a plurality of shock waves at the plurality of windows generated by the hypersonic speeds; and a control unit operable to adjust a real-time trajectory of the hypersonic missile system based on an image formed by the plurality of cameras created from the filtered light from the plurality of windows.

8. The hypersonic missile system of claim 7, wherein each mirror of the plurality of mirrors of the optical subsystem corresponds to a window of the plurality of windows, and wherein mirror shapes of each mirror corresponds to window shapes of each corresponding window.

9. The hypersonic missile system of claim 7, wherein the plurality of windows is closer to the tip of the nose cone than the control unit, the plurality of cameras, and the optical subsystem.

10. The hypersonic missile system of claim 9, wherein each mirror of the plurality of mirrors has a one-to-one correspondence to each window of the plurality of windows.

11. The hypersonic missile system of claim 7, wherein each window of the plurality of windows is configured to filter a wavelength of light corresponding to a camera of the plurality of cameras.

12. A hypersonic missile system comprising:

a missile body comprising a nose cone;

a set of thrusters configured to provide thrust to propel the hypersonic missile system to hypersonic speeds;

a plurality of windows formed in at least a portion of the nose cone, wherein the plurality of windows is configured to filter wavelengths of light providing filtered light to an interior of the nose cone;

a plurality of cameras disposed in the nose cone and configured to receive the filtered light, wherein each camera of the plurality of cameras is configured to detect a different wavelength of light;

an optical subsystem disposed within the nose cone, the optical subsystem comprising:

a plurality of mirrors configured to reflect the filtered light, wherein a first mirror of the plurality of mirrors is configured to direct the filtered light onto a second mirror of the plurality of mirrors and the second mirror is configured to direct the filtered light into at least one camera a limiting aperture configured to filter thermal background radiation;

wherein the plurality of windows is disposed at least ten centimeters from a tip of the nose cone to reduce thermal effects and a number and an intensity of a plurality of shock waves generated at the plurality of windows by the hypersonic speeds; and a control unit operable to adjust a real-time trajectory of the hypersonic missile system based on an image formed by the plurality of cameras created from the filtered light from the plurality of windows wherein the plurality of windows is closer to the tip of the nose cone than the optical subsystem.

13. The hypersonic missile system of claim 12, wherein the filtered light comprises a first wavelength range remaining after filtering by a first window and a second wavelength range remaining after filtering by a second window.

14. The hypersonic missile system of claim 12, wherein the first a wavelength range of the filtered light comprises a short-wave infrared band, and a mid-range infrared band.

15. The hypersonic missile system of claim 12, wherein each window of the plurality of windows is configured to filter a wavelength of light corresponding to a camera of the plurality of cameras.

* * * * *